US009797565B2

(12) United States Patent
Rapeanu

(10) Patent No.: US 9,797,565 B2
(45) Date of Patent: Oct. 24, 2017

(54) LED ENGINE FOR EMERGENCY LIGHTING

(71) Applicant: Thomas & Betts International LLC, Wilmington, DE (US)

(72) Inventor: Radu C. Rapeanu, Mont-Royal (CA)

(73) Assignee: Thomas & Betts International LLC, Wilmington, DE (US)

( * ) Notice: Subject to any disclaimer, the term of this patent is extended or adjusted under 35 U.S.C. 154(b) by 41 days.

(21) Appl. No.: 13/975,928

(22) Filed: Aug. 26, 2013

(65) Prior Publication Data

US 2014/0119013 A1 May 1, 2014

Related U.S. Application Data

(60) Provisional application No. 61/720,418, filed on Oct. 31, 2012.

(51) Int. Cl.
*F21V 13/00* (2006.01)
*F21V 1/00* (2006.01)
(Continued)

(52) U.S. Cl.
CPC ..... *F21S 9/022* (2013.01); *F21V 5/04* (2013.01); *F21Y 2107/10* (2016.08); *F21Y 2115/10* (2016.08)

(58) Field of Classification Search
CPC .. F21S 9/022; F21S 2/005; F21K 9/50; F21Y 2101/02; F21Y 2111/002; F21Y 2105/005; F21W 2131/107; F21V 5/007
(Continued)

(56) References Cited

U.S. PATENT DOCUMENTS 4,985,814 A 1/1991 Lyons
D468,046 S 12/2002 Bernard et al.
(Continued)

FOREIGN PATENT DOCUMENTS

CA 2249423 A1 7/1998
CA 2396813 A1 3/2003
(Continued)

OTHER PUBLICATIONS

"WPC15-WP-Q" QSSI Wall Pack Series WP-35 Catalog Page revised Nov. 2, 2012 and accessed from http://www.qssi.com/wp-content/uploads/catalog/qssi/WPC15-WP-Q.pdf on Jul. 1, 2015.*
(Continued)

*Primary Examiner* — Jong-Suk (James) Lee
*Assistant Examiner* — Erin Kryukova
(74) *Attorney, Agent, or Firm* — Taft Stettinius & Hollister LLP

(57) ABSTRACT

A light engine for a lighting fixture includes a bracket, with multiple mounting surfaces configured at different angles to form a substantially concave region, and a plurality of light emitting diode (LED) modules mounted to the multiple mounting surfaces to project an axis of a light beam from each of the plurality of LED modules along substantially a same illuminating plane. The light engine includes a first set of lenses with a first type of optical surface for focusing a first portion of the plurality of LED modules and a second set of lenses with a second type of optical surface, different than the first type, for focusing a second portion of the plurality of LED modules.

18 Claims, 10 Drawing Sheets

(51) Int. Cl.

| | |
|---|---|
| ***F21V 11/00*** | (2015.01) |
| ***F21V 29/00*** | (2015.01) |
| ***F21S 9/02*** | (2006.01) |
| ***F21V 5/04*** | (2006.01) |
| *F21Y 115/10* | (2016.01) |
| *F21Y 107/10* | (2016.01) |

(58) Field of Classification Search
USPC ..... 362/242
See application file for complete search history.

(56) References Cited

U.S. PATENT DOCUMENTS

| | | | | |
|---|---|---|---|---|
| 6,752,515 | B2 | 6/2004 | Evans et al. | |
| 7,064,674 | B2 | 6/2006 | Pederson | |
| 7,147,348 | B2 | 12/2006 | Heaton et al. | |
| 7,296,913 | B2 | 11/2007 | Catalano et al. | |
| 7,414,546 | B2 * | 8/2008 | Singer et al. | 340/961 |
| 7,434,959 | B1 * | 10/2008 | Wang | 362/249.01 |
| 7,497,587 | B2 | 3/2009 | Klose | |
| 7,674,013 | B2 | 3/2010 | Leslie et al. | |
| 7,703,951 | B2 | 4/2010 | Piepgras et al. | |
| 7,771,087 | B2 | 8/2010 | Wilcox et al. | |
| 7,824,067 | B2 | 11/2010 | Martineau et al. | |
| 8,061,869 | B2 * | 11/2011 | Lo | 362/249.02 |
| 8,092,035 | B2 | 1/2012 | Mandy et al. | |
| 8,414,155 | B2 * | 4/2013 | Catone et al. | 362/249.03 |
| 8,434,900 | B2 * | 5/2013 | Yang | 362/249.03 |
| 8,540,397 | B2 * | 9/2013 | Gill | 362/249.03 |
| 8,950,896 | B2 * | 2/2015 | Nishimori | F21S 2/005 362/244 |
| 2003/0053310 | A1 * | 3/2003 | Sommers | 362/231 |
| 2009/0122546 | A1 * | 5/2009 | Liu | 362/277 |
| 2009/0230833 | A1 * | 9/2009 | Kao et al. | 313/1 |
| 2009/0323343 | A1 * | 12/2009 | Wang | 362/249.11 |
| 2010/0079087 | A1 * | 4/2010 | Watanabe | F21S 8/04 315/294 |
| 2010/0238671 | A1 * | 9/2010 | Catone et al. | 362/373 |
| 2010/0277906 | A1 * | 11/2010 | Choi et al. | 362/235 |
| 2011/0026253 | A1 * | 2/2011 | Gill | 362/249.02 |
| 2011/0051420 | A1 * | 3/2011 | Gill | 362/249.03 |
| 2011/0246146 | A1 * | 10/2011 | Kauffman et al. | 703/2 |
| 2011/0261567 | A1 * | 10/2011 | Lee et al. | 362/249.03 |
| 2012/0051055 | A1 * | 3/2012 | Kauffman et al. | 362/249.02 |
| 2012/0155088 | A1 * | 6/2012 | Spaccasassi et al. | 362/249.04 |
| 2012/0182731 | A1 * | 7/2012 | Kretschmann et al. | 362/235 |
| 2012/0206918 | A1 * | 8/2012 | Lee et al. | 362/249.02 |
| 2014/0066722 | A1 * | 3/2014 | Marka et al. | 600/249 |

FOREIGN PATENT DOCUMENTS

| | | | |
|---|---|---|---|
| CA | 2475675 | A1 | 8/2003 |
| CA | 2634288 | A1 | 12/2003 |
| CA | 2475496 | A1 | 1/2005 |
| CA | 2684214 | A1 | 11/2008 |
| CA | 2729785 | A1 | 1/2010 |
| CA | 2736395 | A1 | 3/2010 |
| CA | 2654224 | A1 | 8/2010 |
| CA | 2759812 | A1 | 9/2010 |
| CA | 2702685 | A1 | 11/2010 |
| CA | 2767142 | A1 | 2/2011 |

OTHER PUBLICATIONS

"PGN Emergency Light, Wet Location, LED, Die-Cast Aluminum," Dual Lite Life Safety Solutions. http://www.dual-lite.com/products/pgn. Aug. 26, 2013.

"Diskuss LED Wall Light," Philips Chloride. http://www.chloridesys.com/pdfspecs/CM-25400.pdf. Aug. 26, 2013.

"AFN Affinity Architectural Die-Cast Emergency Lighting," Lithonia Lighting. http://www.lithonia.com/commercial/afn.html?pt=emergency#.UhtzVYzD-Uk. Aug. 26, 2013.

"CM-25050 Architectural Emergency Patron LED Series Die-Cast Aluminum LED Wall Light/Unit," Philips Chloride. http://www.chloridesys.com/pdfspecs/CM-25050.pdf. Aug. 26, 2013.

* cited by examiner

LED ENGINE FOR EMERGENCY LIGHTING

BACKGROUND INFORMATION

This application claims priority under 35 U.S.C. §119, based on U.S. Provisional Patent Application No. 61/720,418 filed Oct. 31, 2012, the disclosure of which is hereby incorporated by reference herein.

BACKGROUND INFORMATION

The light-emitting diode (LED) has become a popular alternative to the incandescent bulb due to lighting performance and efficacy (lumen/watt), color rendering, and operational life. In emergency lighting, LED lamps provide additional cost savings by down-sizing the required back-up energy (battery) and creating opportunities for equipment miniaturization. Given the technological differences between incandescent lamps and LEDs, the replacement of incandescent lamps with LEDs can require major design revisions for existing lighting fixtures including electrical power supply, thermal management, and light distribution.

DETAILED DESCRIPTION OF PREFERRED EMBODIMENTS

The following detailed description refers to the accompanying drawings. The same reference numbers in different drawings may identify the same or similar elements.

A light engine for an emergency lighting fixture may include a bracket, with multiple mounting surfaces configured at different angles to form a substantially concave region, and a plurality of light emitting diode (LED) modules mounted to the multiple mounting surfaces. The bracket may be configured to project an axis of a light beam from each LED module in substantially the same plane. The light engine includes a first set of lenses with a first type of optical surface for focusing a first portion of the plurality of LED modules and a second set of lenses with a second type of optical surface, different than the first type, for focusing a second portion of the plurality of LED modules. The different sets of lenses enable precise design of the total light distribution from the light engine. The mounting surfaces allow the LED modules and lenses to be mounted in a compact manner with a small window size for the lighting fixture.

Figure 1A:
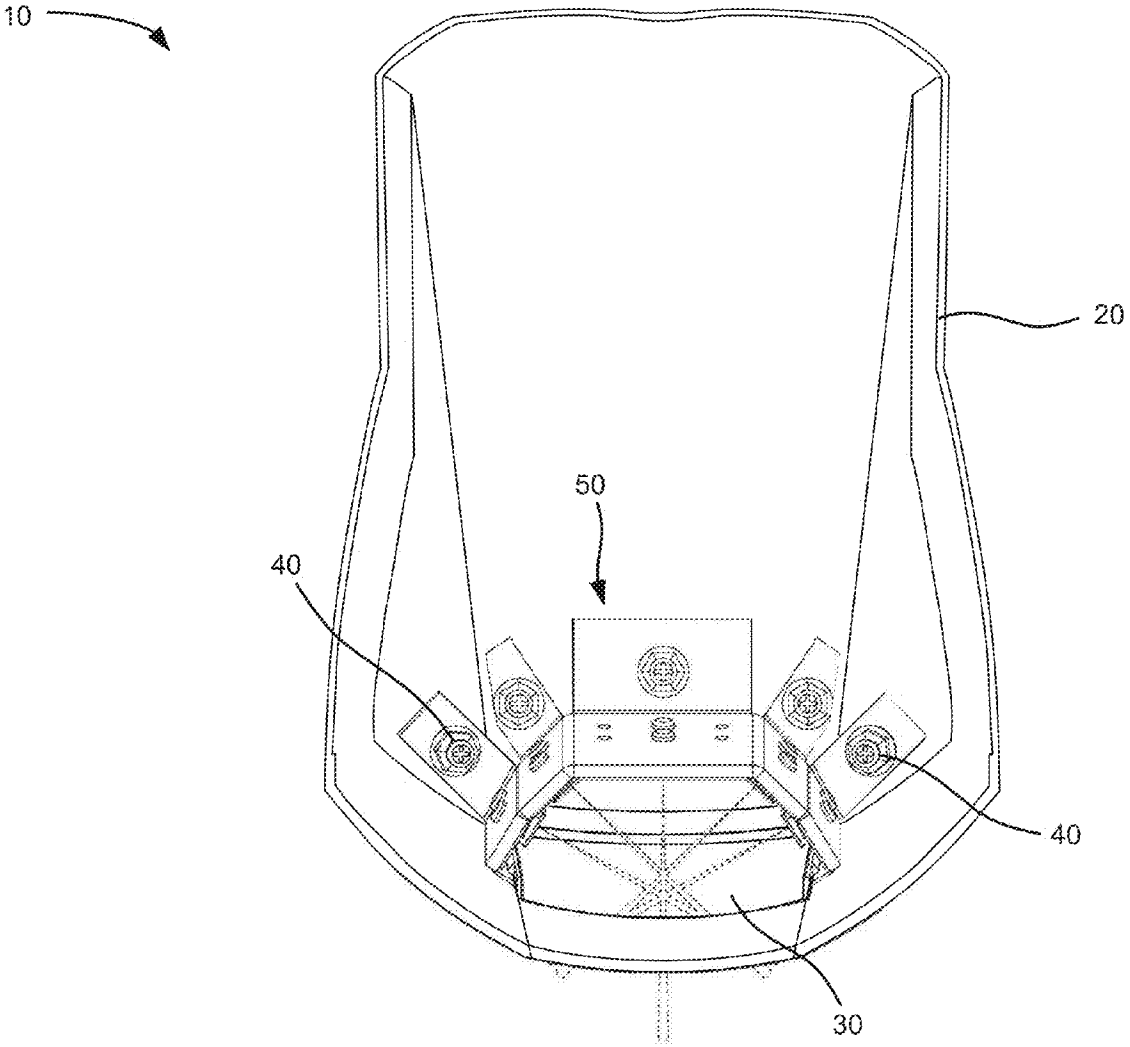
FIG. 1A is an illustration of a perspective view of an underside of an emergency lighting fixture with a back cover removed, according to an implementation described herein.
Figure 1B:
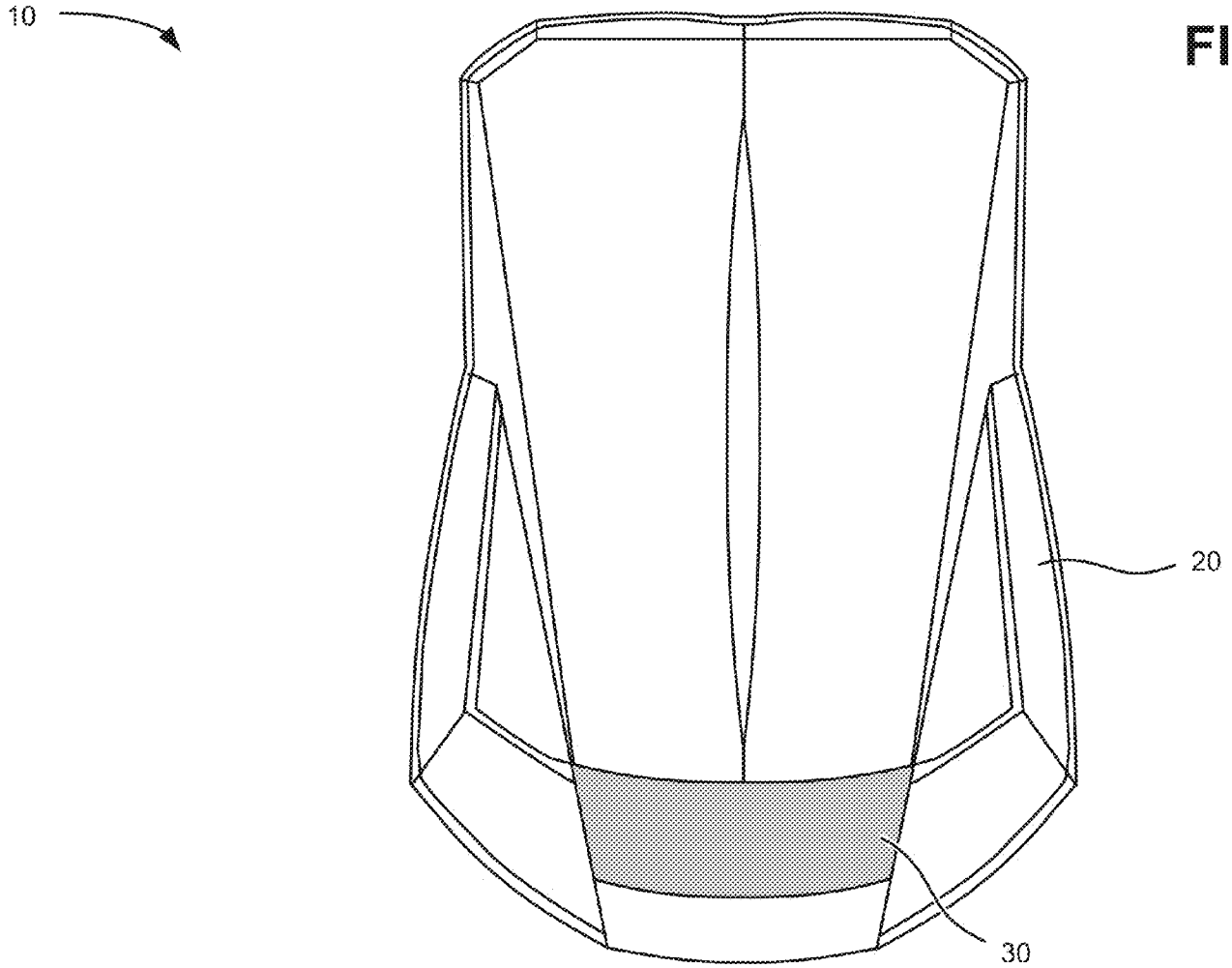
FIG. 1B is an illustration of a perspective view of a front side of the emergency lighting fixture of FIG. 1A.

FIG. 1A provides a perspective view of an underside of an emergency lighting fixture 10 with a back cover removed. FIG. 1B provides a perspective view of a front side of the emergency lighting fixture 10. Referring collectively to FIGS. 1A and 1B, lighting fixture 10 may include a housing 20, an illumination window 30, fasteners 40, and a lighting engine 50. Generally, lighting fixture 10 may be mounted high (e.g., approximately eight to ten feet) on a vertical wall (e.g., with illumination window 30 facing downward) to provide downward illumination of a walking path or corridor.

Housing 20 may include a metal enclosure to secure illumination window 30, fasteners 40, lighting engine 50, and other components, such as a power supply, a controller, mounting hardware, and/or electrical circuitry (not shown). In conjunction with a back cover (not shown), housing 20 may provide a watertight enclosure and enable lighting fixture 10 to be secured to a wall or another surface. Housing 20 may include a generally rectangular opening in which to secure illumination window 30. Housing 20 may provide a structure on which to mount lighting engine 50. More particularly, fasteners 40 may be used to secure and position a bracket of lighting engine 50 to so as to emit light through illumination window 30. As described further herein, the bracket of lighting engine 50 may have thermal conductivity with housing 20 on the areas around fasteners 40 to transfer heat from lighting engine 50.

Illumination window 30 may include a generally transparent panel inserted into the opening of housing 20. Window 30 may be made from, for example, clear polycarbonate or glass. Illumination window 30 may permit light from light engine 50 to pass through to provide illumination to an area below illumination window 30. As described further herein, the configuration of light engine 50 allows illumination window 30 to be relatively small in comparison to conventional LED fixtures (e.g., less than five percent of the surface area of housing 20) to protect against mechanical stress and provide unique aesthetics for emergency lighting fixture 10.

Light engine 50 may provide an illumination source for light fixture 10. Light engine 50 may generally include LEDs mounted to a bracket at different angles, with each LED fitted with a particular lens to optimize light distribution from light engine 50. Light engine 50 is described further in connection with FIGS. 2-6. As described further herein, light engine 50 may provide improved efficiency by eliminating use of reflectors, may permit fine-tuned light distribution, and may employ a smaller window (e.g. illumination window 30) in housing 20 than can be used in conventional emergency light fixtures.

Although FIGS. 1A and 1B show an exemplary lighting fixture 10, in other implementations, lighting fixture 10 may include fewer components, different components, differently-arranged components, or additional components than depicted in FIGS. 1A and 1B.

Figure 2:
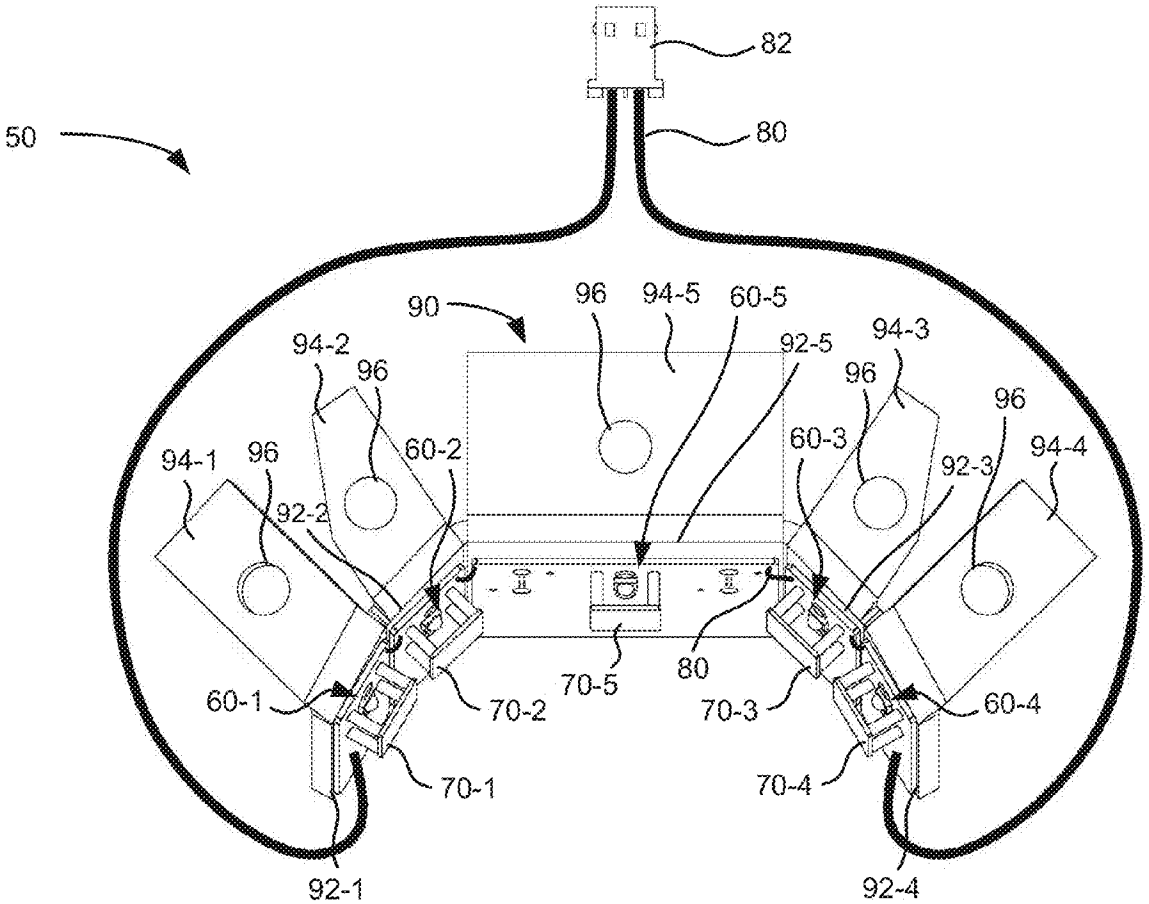
FIG. 2 is an illustration of a front perspective view of a light engine of FIG. 1A.

FIG. 2 provides a front perspective view of light engine 50. As shown in FIG. 2, light engine 50 may include multiple LED modules 60-1 through 60-5 (referred to herein collectively as "LED modules 60" and generically as "LED module 60"), multiple lenses 70-1 through 70-5 (referred to herein collectively as "lenses 70" and generically as "lens 70"), and connecting wires 80 mounted on a bracket 90.

Figure 3:
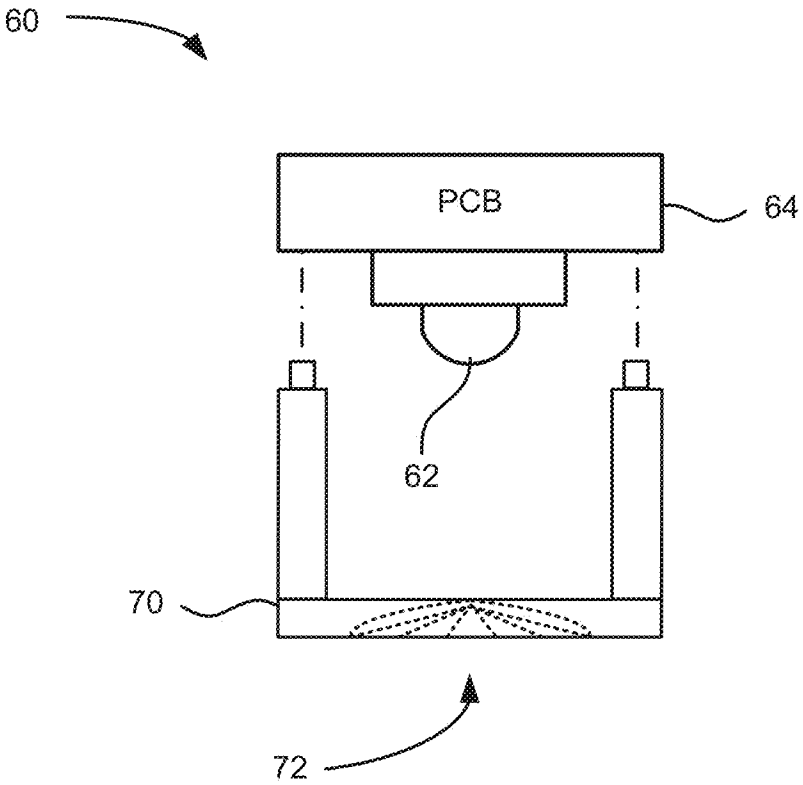
FIG. 3 is a simplified assembly schematic of an LED module and lens of the light engine of FIG. 1A.

FIG. 3 provides a simplified assembly schematic of LED module 60 and lens 70. Each LED module 60 may include an illuminating LED 62 mounted on a printed circuit board 64 (or another electrical conducting structure). LED 62 may be selected to provide a particular amount of visible light (e.g., lumens) at a particular power level (e.g., from the power supply). LED 62 may be selected from a variety of colors. In some instances, printed circuit board 64 may include mounting space for multiple LEDs 62 and corresponding lenses 70. In some implementations, LED module 60 may also include an insulator (e.g., between printed circuit board 64 and bracket 90), surge protection, or other components (not shown).

Lenses 70 may be selected with specific optical surfaces 72 to orient light from LED modules 60 in particular manners, as described below. Each lens 70 may be mounted, for example, to one of PCBs 64 of a corresponding LED module 60. Lens 70 may be secured, for example, using an adhesive (e.g., epoxy, silicone, etc.) or mechanical attachment (e.g., clip, screw, rivet, etc.). Generally, lenses 70 have a high transmission efficiency sufficient to provide from a particular mounted height (and in combination with properties of LEDs 62) a code-specified illumination (e.g., at least one foot-candle) for a portion of a walking path. In one implementation, each lens 70 may include a base, posts, or a holder that may be integrated with or connected to lens 70.

Each of the optical surfaces 72 may provide one of a variety of beam angles or light distributions. For example, selected lenses 70 may provide a narrow circular (or spot) beam shape for some LED modules 60 and a wide beam or an elliptical beam shape for other LED modules 60. Other types of lenses 70 that may be used in other implementations include optical surfaces for rectangular beam shapes, for square beam shapes, side-emitting beam, ultra-wide (or "bubble") beam, etc. Each lens 70 may be made from a known optic material, such as polycarbonate or polymethylmethacrylate (PMMA).

Referring again to FIG. 2, wires 80 may connect LED modules 60 to a controller and/or power source via a connector 82. In one implementation, LED modules 60 may be electrically connected via the printed circuit boards 64 in series and powered via two wires 80. In other implementations, LED modules 60 may be electrically connected in parallel or in a combination of series and parallel.

Bracket 90 may provide mounting surfaces for LED modules 60. Bracket 90 may include a heat-conductive material to act as a heat sink and provide heat transfer from LED modules 60. Bracket 90 may, for example, be formed from a die-cast or extruded metal such as aluminum. Bracket 90 may include a set of mounting surfaces 92-1 through 92-5 (referred to herein collectively as "mounting surfaces 92" or generically as "mounting surface 92") and a set of flanges 94-1 through 94-5 (referred to herein collectively as "flanges 94" or generically as "flange 94") with fastener holes 96.

Figure 4:
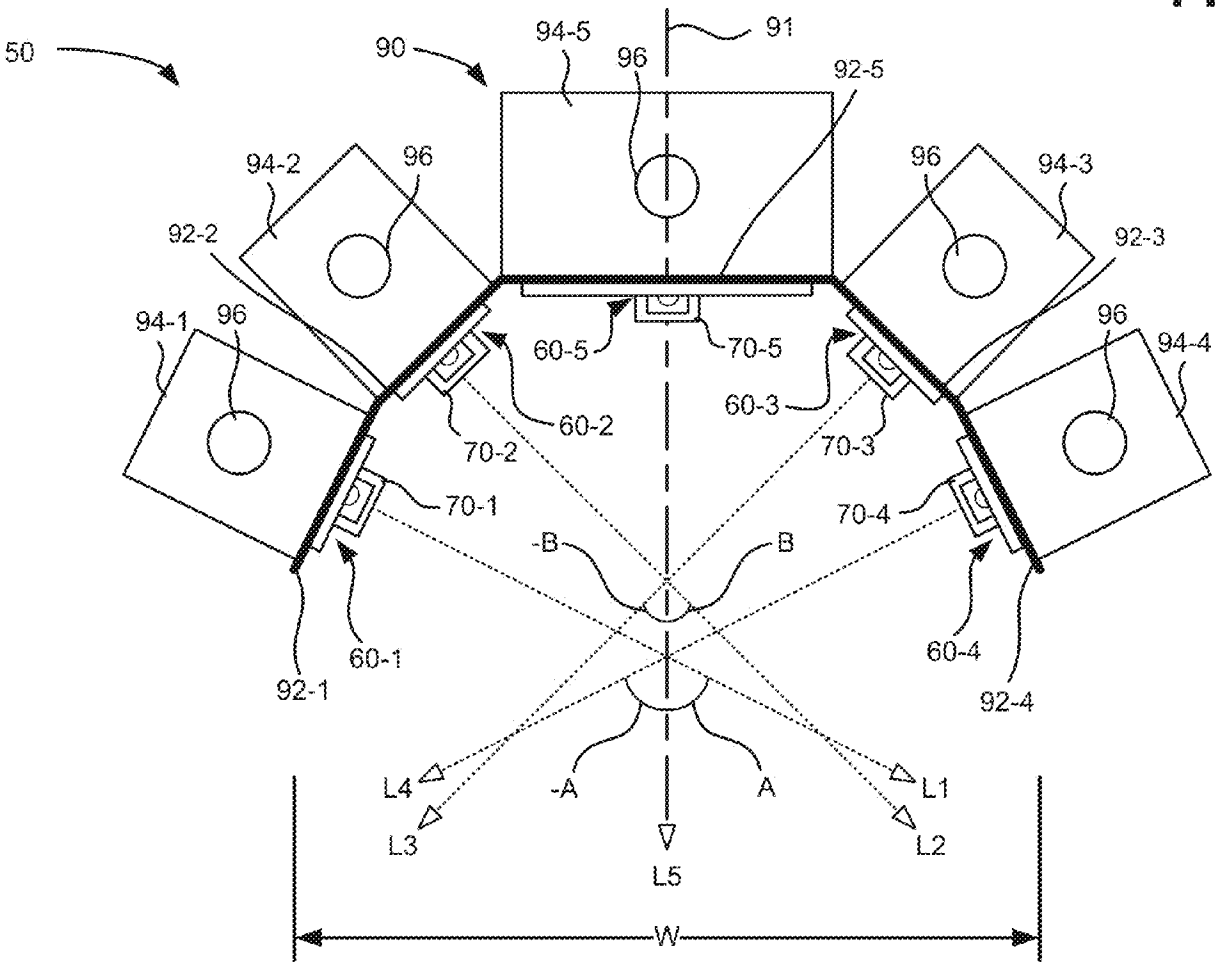
FIG. 4 is a simplified schematic of a front view of the light engine of FIG. 1A including a light beam pattern.
Figure 5:
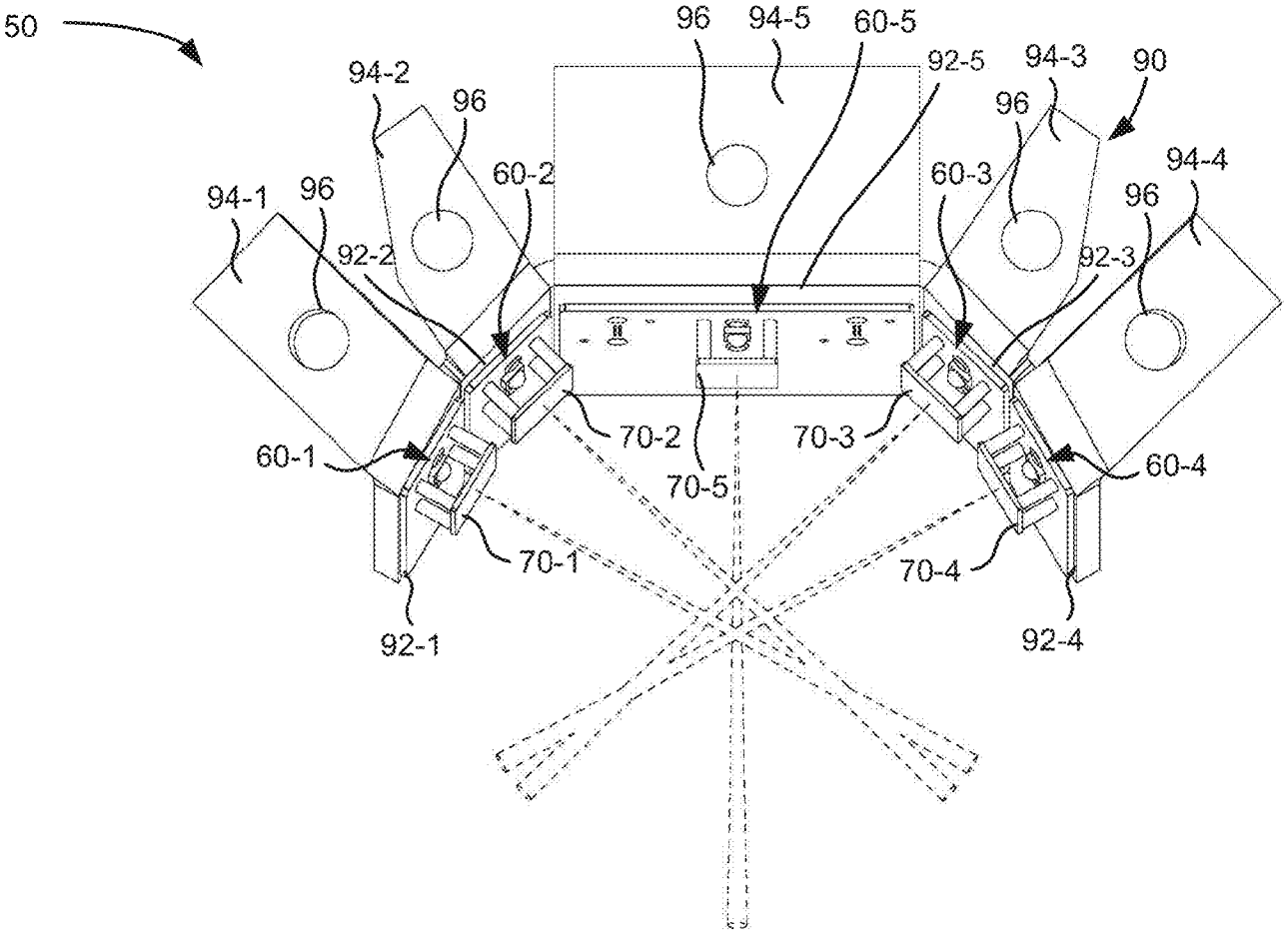
FIG. 5 is an illustration of a front perspective view of the light engine of FIG. 1A including a light beam pattern.

FIG. 4 provides a simplified schematic of a front view of light engine 50 including a light beam pattern according to an implementation described herein. FIG. 5 provides an illustration of a front perspective view of light engine 50 including a similar light beam pattern. As shown in FIGS. 4 and 5, bracket 90 may include mounting surfaces 92 configured at multiple angles to form a concave region similar to a horseshoe (e.g., the concave region is substantially within a single plane). Each mounting surface 92 may support an LED module 60 in a position so that an axis of a light beam (e.g., L1, L2, L3, L4, and L5) from one of LED modules 60 is generally orthogonal to the plane of the corresponding mounting surface 92. In one implementation, mounting surfaces 92 and corresponding LED modules 60 may be positioned symmetrically on bracket 90 with respect to a vertical bisecting line 91.

For example, as shown in FIG. 4, LED modules 60-1 and 60-4 may be mounted as mirror images to provide light beams at a first angle, "A," with respect to bisecting line 91. Similarly, still referring to FIG. 4, LED modules 60-2 and 60-3 may be mounted as mirror images to provide light beams at a second angle, "B," with respect to bisecting line 91. LED module 60-5 may provide a light beam (not shown for clarity) directly along bisecting line 91. Angles A and B may be measured within the same illuminating plane P, described below in connection with FIG. 6. In one implementation, angle A may correspond to an angle of approximately ±60 degrees and angle B may correspond to an angle of approximately ±45 degrees. In other implementations, different values for either of angle A or angle B may be used. In still other implementations, mounting surfaces 92 may be asymmetrical. For example, mounting surfaces 92 may be asymmetrically configured to provide a left- or right-skewed light distribution pattern.

As shown in FIGS. 4 and 5, flanges 94 may extend at an angle from a corresponding mounting surface 92. Flanges 94 may permit heat transfer away from LED modules 60. Flanges 94 may also include holes 96 to provide a point of attachment for bracket 90 to housing 20. Holes 96 may be configured, for example, to receive fasteners 40 (FIG. 1A) to secure bracket 90 to housing 20. When secured to housing 20, flanges 94 may provide thermal contact to dissipate heat (e.g., heat generated by LED modules 60 and conducted through bracket 90) from flanges 94 to housing 20. Thus, bracket 90 and housing 20 may provide heat transfer while maintaining a sealed (e.g., water-tight) enclosure. In one implementation, holes 96 may be configured to match a standardized pattern of threaded openings in housing 20. Thus, different configurations of light engines 50 may be used within housing 20, so long as the alignment of holes 96 remains consistent. For example, as described further in connection with FIG. 8, light engines with different illumination patterns may be interchangeable within the same housing 20.

As shown in FIG. 4, the beam axes of light from LED modules 60 (e.g., L1, L2, L3, L4) may cross each other within the width, W, of the concave region of mounting bracket 90. In one implementation, as shown in FIG. 1A, a beam axis of light from each of LED modules 60 may cross every other beam axis inside the area of housing 20/window 30. For example, as shown in FIG. 4, a light beam from LED module 60-1 may cross light beams from LED modules 60-2, 60-3, 60-4, and 60-5 within width W. In still another implementation, a beam axis from each of LED modules 60 may cross at least beam axes originating from the opposite side of bisecting line 91 within the area of housing 20/window 30. In other implementations, beam axes from light beams of each of LED modules 60 may not cross light beams from LED modules on a same side of bisecting line 91. For example, a light beam from LED module 60-1 could cross light beam axes from LED modules 60-3, 60-4, and 60-5, but not a light beam axis from LED module 60-2.

Figure 6:
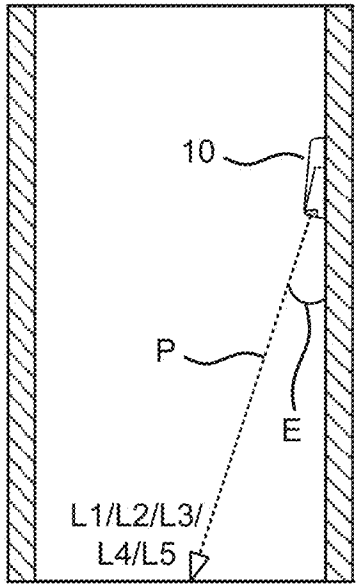
FIG. 6 provides a simplified schematic of a side view the emergency lighting fixture of FIG. 1A including a light beam pattern according to an implementation described herein.

FIG. 6 provides a simplified schematic of a side view of lighting fixture 10 including a light beam pattern according to an implementation described herein. Referring collectively to FIGS. 4-6, when emergency lighting fixture 10 is installed on a wall (or another vertical surface) with light engine 50 secured within housing 20, the concave region of bracket 90 may be angled to project an axis of each light beam (e.g., L1, L2, L3, L4, and L5) in substantially the same illuminating plane, P, angling slightly away from the base of the wall. The angle, E, of illuminating plane P with respect to the wall may be configured for particular applications, but may generally be in the range of 10 to 45 degrees. In an exemplary application, angle E may be about 17-20 degrees.

Figure 7:
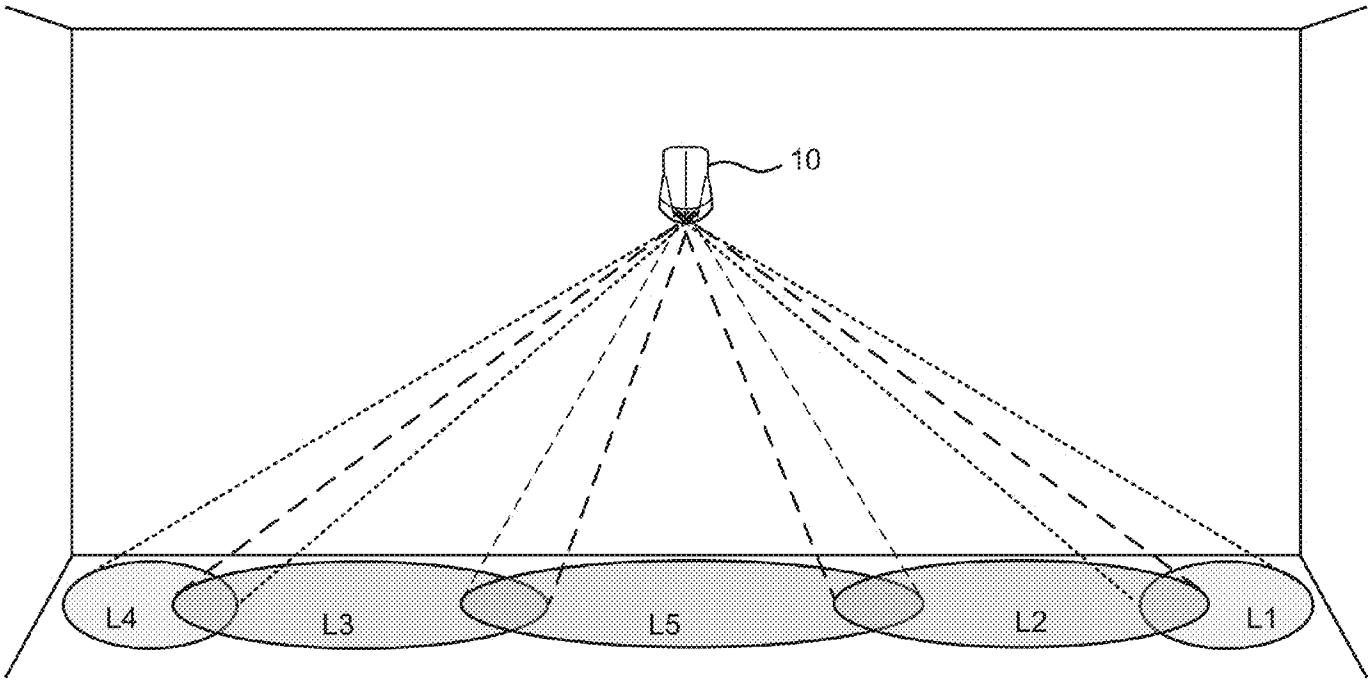
FIG. 7 is an illustration of an exemplary illumination pattern of the light engine of FIG. 4.

In one implementation, lenses 70 may include different optical surfaces 72 for different LED modules 60 to distribute light evenly along, for example, a corridor or walking path. The use of different types of lens allows for a precise design of the total light distribution from lighting engine 50 with a minimum number of LED modules 60 (e.g., only four or five LED modules). FIG. 7 provides an illustration of an exemplary illumination pattern from lighting fixture 10 with light engine 50. The light beam of each LED module 60 can be clustered in a specific pattern and oriented in a specific direction. The total light distribution equals the sum (overlapping) of the individual beams. Referring to FIGS. 4 and 7, a first set of lenses (e.g., lenses 70-2, 70-3, and 70-5) may provide wide beam or elliptical beam distributions for orienting light from LED modules 60-2, 60-3, and 60-5 on areas relatively close to light fixture 10, as indicated by L2, L3, and L5. Conversely, a second set of lenses (e.g., lenses 70-1 and 70-4) may be of a narrow beam type for focusing light from LED modules 60-1 and 60-4 on areas relatively far from light fixture 10, as indicated by L1 and L4.

Figure 8:
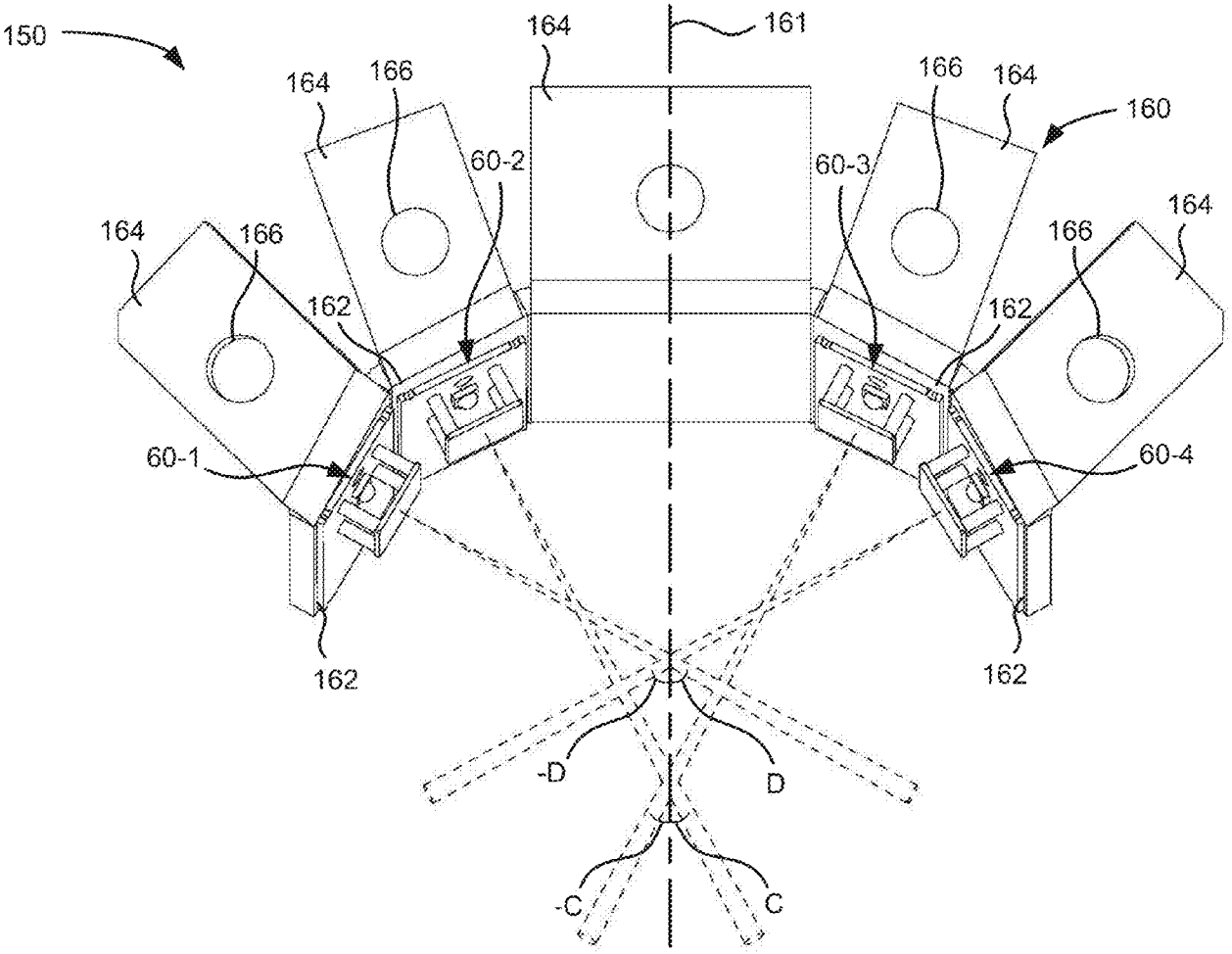
FIG. 8 is an illustration of a front perspective view of a four-LED light engine including a light beam pattern according to another implementation described herein.

FIG. 8 provides a front perspective view of a light engine 150 with a four-LED configuration and including a light beam pattern according to another implementation described herein. Light engine 150 may be configured similarly to light engine 50 described above, but with only four LED modules 60. Particularly, light engine 150 may include LED modules 60-1 through 60-4, multiple lenses 70-1 through 70-4, and connecting wires 80 (not shown in FIG. 8) mounted on bracket 160.

Bracket 160 may include multiple mounting surfaces 162 and flanges 164 with fastener holes 166. In one implementation, flanges 164 may be configured to align fastener holes 166 in the same manner as fastener holes 96 of bracket 50. Thus, light engine 150 may be interchangeable (e.g., as part of a factory installation) with other light engines so that a single housing 20 for emergency light fixture 10 may be configured with different light engines and light distribution patterns. For example, light engines may be provided as modular units to provide different light distributions for particular height or distance requirements along a wall. Additionally, a different modular light engine may be provided with a forward throw light pattern for use in housing 20.

LED modules 60-1 and 60-4 may be mounted on bracket 160 as mirror images to provide light beams at a first angle, C, with respect to a bisecting line 161. Similarly, LED modules 60-2 and 60-3 may be mounted on bracket 160 as mirror images to provide light beams at a second angle, D, with respect to the bisecting line 161. Similar to angles A and B described above, angles C and D may be measured within the same illuminating plane P described in connection with FIG. 6. In one implementation, angle C may correspond to an angle of approximately ±60 degrees and angle D may correspond to an angle of approximately ±27 degrees. In other implementations, different values for either of angle C or angle D may be used. In still other implementations, mounting surfaces 162 may be asymmetrical. For example, mounting surfaces 162 may be asymmetrically configured to provide a left- or right-skewed light distribution pattern.

Figure 9:
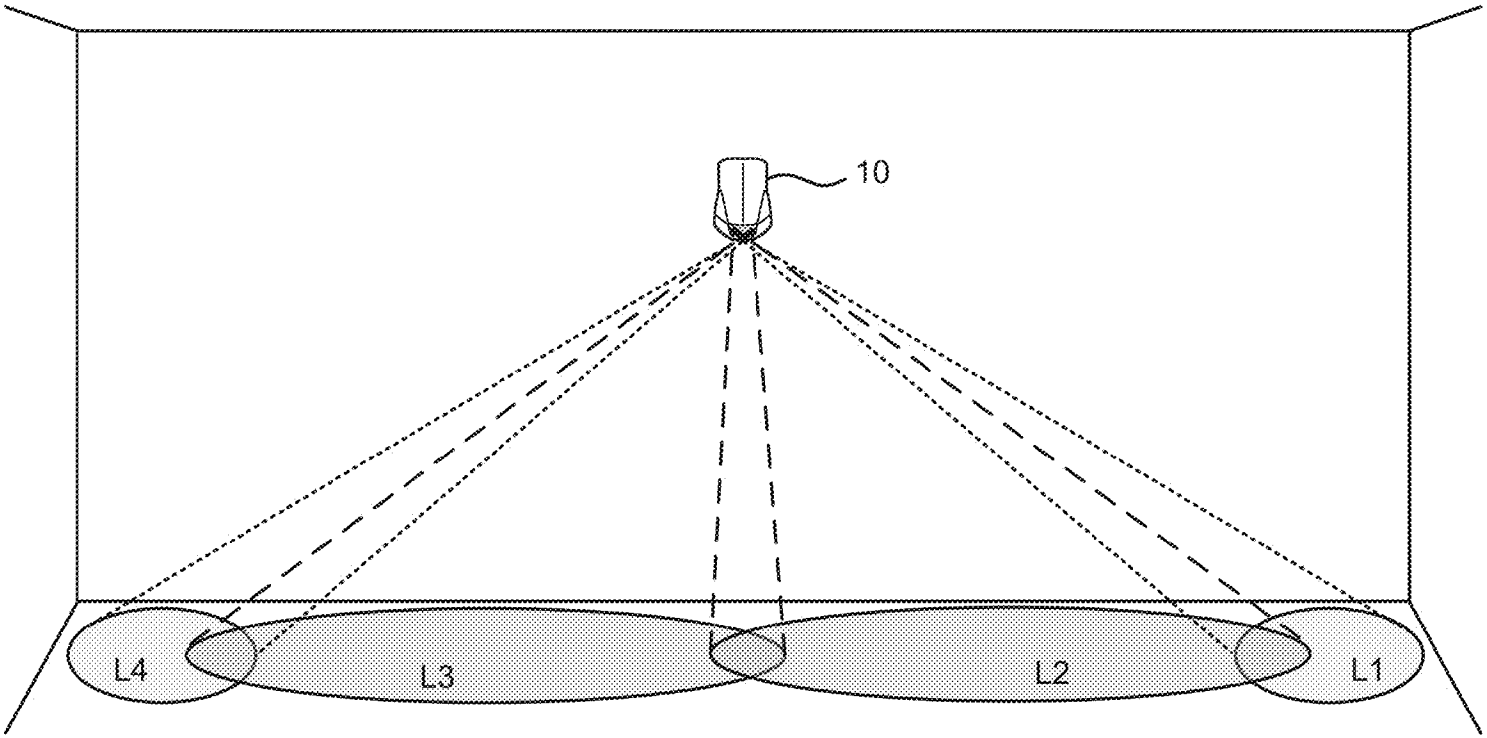
FIG. 9 is an illustration of an exemplary illumination pattern of the light engine of FIG. 8.

Similar to descriptions above in connection with light engine 50, lenses 70 in light engine 150 may have different optical surfaces 72 for different LED modules 60 to distribute light along a corridor or walking path. The use of different optical surfaces allows for a precise design of the total light distribution from lighting engine 150. FIG. 9 provides an illustration of an exemplary illumination pattern from lighting fixture 10 with light engine 150. The light beam of each LED module 60 can be clustered in a specific pattern and oriented in a specific direction. The total light distribution equals the sum (overlapping) of the individual beams. Referring to FIGS. 7 and 8, a first set of lenses (e.g., lenses 70-2 and 70-3) may provide wide beam or elliptical beam light distributions for orienting light from LED modules 60-2 and 60-3 on areas relatively close to light fixture 10, as indicated by L2 and L3. Conversely, a second set of lenses (e.g., lenses 70-1 and 70-4) may be of a narrow beam type for focusing light from LED modules 60-1 and 60-4 on areas relatively far from light fixture 10, as indicated by L1 and L4.

Implementations described herein provide a light engine for a lighting fixture, such as an emergency lighting fixture. The light engine may uses multiple lens types to permit fine-tuned light distribution of LED modules and can eliminates use of reflectors. Light beams from the light engine may cross each other to provide a space-efficient design, allowing the light engine to employ a small window in the housing of the lighting fixture.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A light engine for an emergency lighting fixture, comprising:

a bracket including:

five adjoining mounting surfaces, each of the adjoining mounting surfaces configured to receive a printed circuit board with one light emitting diode (LED) module and a lens, and each of the adjoining mounting surfaces configured at different angles to form a concave region extending from a distal first end of the bracket to an opposing second distal end of the bracket along a two-dimensional illuminating plane, and multiple flanges extending at an angle from at least some of the adjoining mounting surfaces, wherein each of the multiple flanges includes mounting holes to provide a point of attachment to a housing, the housing configured to provide an external enclosure for at least the light engine;

a first LED module and a first lens mounted to a first of the adjoining mounting surfaces, the first LED module projecting an axis of a first light beam through the first lens, and in the two-dimensional illuminating plane, at an angle of 60 degrees relative to a bisecting line of the concave region in the two-dimensional illuminating plane;

a second LED module and a second lens mounted to a second of the adjoining mounting surfaces, the second LED module projecting an axis of a second light beam through the second lens, and in the two-dimensional illuminating plane, at an angle of 45 degrees relative to the bisecting line;

a third LED module and a third lens mounted to a third of the adjoining mounting surfaces, the third LED module projecting an axis of a third light beam through the third lens, and in the two-dimensional illuminating plane, at an angle of −45 degrees relative to the bisecting line;

a fourth LED module and a fourth lens mounted to a fourth of the adjoining mounting surfaces, the fourth LED module projecting an axis of a fourth light beam through the fourth lens, and in the two-dimensional illuminating plane, at an angle of −60 degrees relative to the bisecting line; and a fifth LED module and a fifth lens mounted to a fifth of the adjoining mounting surfaces, the fifth LED module projecting an axis of a fifth light beam through the fifth lens, and in the two-dimensional illuminating plane, along the bisecting line, wherein the first lens and the fourth lens include a first type of optical surface that provides narrow beam light distribution, wherein the second lens and the third lens include a second type of optical surface that provides elliptical beam or wide beam light distribution, wherein the light engine projects the axes of first, second, third, fourth, and fifth light beams, in the two-dimensional illuminating plane through an exterior opening of the housing that is smaller than a width of the concave region from the first distal end to the second distal end across the adjoining mounting surfaces of the bracket, and wherein the light engine for the emergency light fixture includes no reflectors.

2. The light engine of claim 1, wherein each of the adjoining mounting surfaces are orthogonal to the two-dimensional illuminating plane.

3. The light engine of claim 1, wherein the bracket is configured to act as a heat sink for the LED modules.

4. The light engine of claim 3, wherein the bracket is configured to be mounted to the housing to provide thermal conductivity to the housing.

5. The light engine of claim 1, wherein the light engine is configured to be installed in the housing so that the axes of the first, second, third, fourth, and fifth light beams intersect each other within the housing for the light engine.

6. The light engine of claim 1, wherein the light engine is configured so that the axes of the first, second, third, fourth, and fifth light beams intersect each other within a width of the concave region.

7. The light engine of claim 1, wherein the fifth lens includes the first type of optical surface that provides elliptical beam or wide beam light distribution.

8. An emergency lighting fixture, comprising:

a housing configured to be mounted on a vertical wall surface, the housing including a thermally conductive material and an exterior opening;

a window secured within the exterior opening; and a light engine including:

a bracket with multiple mounting surfaces, each of the multiple mounting surfaces being configured to receive a light emitting diode (LED) module and a lens and to direct an axis of a light beam from the LED module through the lens in a two-dimensional illuminating plane, wherein the multiple mounting surfaces form a substantially concave region extending from a distal first end of the bracket to an opposing second distal end of the bracket along the two-dimensional illuminating plane, and wherein the bracket is mounted to the housing, a first LED module and a first lens mounted to a first of the multiple mounting surfaces, the first LED module projecting an axis of a first light beam through the first lens, and in the two-dimensional illuminating plane, at a first angle relative to a bisecting line of the concave region in the two-dimensional illuminating plane, a second LED module and a second lens mounted to a second of the multiple mounting surfaces, the second LED module projecting an axis of a second light beam through the second lens, and in the two-dimensional illuminating plane, at a second angle relative to the bisecting line, a third LED module and a third lens mounted to a third of the multiple mounting surfaces, the third LED module projecting an axis of a third light beam through the third lens, and in the two-dimensional illuminating plane, at a third angle relative to the bisecting line, a fourth LED module and a fourth lens mounted to a fourth of the multiple mounting surfaces, the fourth LED module projecting an axis of a fourth light beam through the fourth lens, and in the two-dimensional illuminating plane, at a fourth angle relative to the bisecting line, and a fifth LED module and a fifth lens mounted to a fifth of the multiple mounting surfaces, the fifth LED module projecting an axis of a fifth light beam through the fifth lens, and in the two-dimensional illuminating plane, along the bisecting line, wherein the first lens and the fourth lens include a first type of optical surface that provides narrow beam light distribution, wherein the second lens and the third lens include a second type of optical surface that provides elliptical beam or wide beam light distribution, and wherein the two-dimensional illuminating plane is angled downward and away from the vertical wall surface at an angle of between 10 and 45 degrees, wherein a width of the window in the two-dimensional illuminating plane is less than a width of the concave region from the first distal end to the second distal end across the adjoining mounting surfaces of the bracket, and wherein the light engine for the emergency light fixture includes no reflectors.

9. The emergency lighting fixture of claim 8, wherein the bracket includes another thermally conductive material and wherein the bracket conducts heat from the LED modules to the housing.

10. The emergency lighting fixture of claim 8, wherein the fifth lens includes the first type of optical surface that provides elliptical beam or wide beam light distribution.

11. The emergency lighting fixture of claim 8, wherein the axes of the first, second, third, fourth, and fifth light beams intersect each other within the housing.

12. An emergency lighting fixture, comprising:

a housing configured to be mounted on a vertical wall surface, the housing including a thermally conductive material and an exterior opening;

a window secured within the exterior opening; and a light engine including:

a bracket including five adjoining mounting surfaces, each of the adjoining mounting surfaces configured to receive a printed circuit board with one light emitting diode (LED) module and a lens, and each of the adjoining mounting surfaces configured at different angles substantially within a two-dimensional illuminating plane, wherein the adjoining mounting surfaces form a concave region extending from a distal first end of the bracket to an opposing second distal end of the bracket with the two-dimensional illuminating plane, a first LED module and a first lens mounted to a first of the adjoining mounting surfaces, the first LED module projecting an axis of a first light beam through the first lens, and in the two-dimensional illuminating plane, at an angle of 60 degrees relative to a bisecting line of the concave region in the two-dimensional illuminating plane, a second LED module and a second lens mounted to a second of the adjoining mounting surfaces, the second LED module projecting an axis of a second light beam through the second lens, and in the two-dimensional illuminating plane, at an angle of 45 degrees relative to the bisecting line, a third LED module and a third lens mounted to a third of the adjoining mounting surfaces, the third LED module projecting an axis of a third light beam through the third lens, and in the two-dimensional illuminating plane, at an angle of −45 degrees relative to the bisecting line, a fourth LED module and a fourth lens mounted to a fourth of the adjoining mounting surfaces, the fourth LED module projecting an axis of a fourth light beam through the fourth lens, and in the two-dimensional illuminating plane, at an angle of −60 degrees relative to the bisecting line, and a fifth LED module and a fifth lens mounted to a fifth of the adjoining mounting surfaces, the fifth LED module projecting an axis of a fifth light beam through the fifth lens, and in the two-dimensional illuminating plane, along the bisecting line, wherein the adjoining mounting surfaces are configured to cause beam axes from each of the LED modules to intersect each other within a width of the concave region and within the two-dimensional illuminating plane, the width of the concave region from the first distal end to the second distal end across the adjoining mounting surfaces being larger than a corresponding width of the exterior opening.

13. The emergency lighting fixture of claim 12, wherein the second lens and the third lens include a first type of optical surface that provides elliptical beam light distribution and wherein the first lens and the fourth lens include a second type of optical surface that provides narrow beam light distribution.

14. The emergency lighting fixture of claim 12, wherein the bracket is configured to act as a heat sink for the LED modules.

15. The emergency lighting fixture of claim 12, wherein the housing includes a watertight metal enclosure for the light engine, wherein the window includes a polycarbonate or glass material, and wherein a surface area of the window is less than five percent of the surface area of the housing.

16. The emergency lighting fixture of claim 12, wherein the light engine is configured to be installed in the housing so that the axes of the first, second, third, fourth, and fifth light beams intersect each other within the housing.

17. The emergency lighting fixture of claim 12, wherein the two-dimensional illuminating plane is angled downward and away from the vertical wall surface at an angle of between 10 and 45 degrees.

18. The emergency lighting fixture of claim 8, wherein the housing includes a watertight metal enclosure for the light engine, wherein the window includes a polycarbonate or glass material, and wherein a surface area of the window is less than five percent of the surface area of the housing.

* * * * *